US009022677B1

(12) United States Patent
Hughes et al.

(10) Patent No.: US 9,022,677 B1
(45) Date of Patent: May 5, 2015

(54) WRITING APPARATUS

(71) Applicants: Clifford A. Hughes, Garden Grove, CA (US); Laura Hughes, Garden Grove, CA (US)

(72) Inventors: Clifford A. Hughes, Garden Grove, CA (US); Laura Hughes, Garden Grove, CA (US)

( * ) Notice: Subject to any disclaimer, the term of this patent is extended or adjusted under 35 U.S.C. 154(b) by 0 days.

(21) Appl. No.: 14/105,609

(22) Filed: Dec. 13, 2013

(51) Int. Cl.
*B43K 27/00* (2006.01)
*B43K 29/20* (2006.01)

(52) U.S. Cl.
CPC ..... *B43K 29/20* (2013.01)

(58) Field of Classification Search
USPC ..... 401/52, 195, 109–112, 29–33
See application file for complete search history.

(56) References Cited

U.S. PATENT DOCUMENTS

| | | | | | |
|---|---|---|---|---|---|
| 1,447,727 | A * | 3/1923 | Kendall | ..... | 401/82 |
| 3,615,596 | A * | 10/1971 | Petti et al. | ..... | 426/104 |
| 5,158,384 | A | 10/1992 | Radmilovic et al. | | |
| 5,184,908 | A * | 2/1993 | Yamamoto et al. | ..... | 401/29 |
| 5,826,997 | A | 10/1998 | Coleman et al. | | |
| 5,951,184 | A * | 9/1999 | Sanchez | ..... | 401/52 |
| 6,902,333 | B2 * | 6/2005 | Miyagawa et al. | ..... | 401/66 |

* cited by examiner

*Primary Examiner* — David Walczak
(74) *Attorney, Agent, or Firm* — Crossley Patent Law

(57) ABSTRACT

A writing apparatus that provides a writing tool and also provides a small compartment for mounting and holding a piece of food, preferably candy, for consumption. The writing apparatus is preferably a pen that includes an internal pen casing with a volume of ink. In addition, an item of food, preferably candy, is located in a rear-mounted compartment on the writing apparatus and can be exposed when an individual is hungry. A cap can be used to cover the item of food when an individual is not hungry or when the writing apparatus is being used for writing.

8 Claims, 4 Drawing Sheets

WRITING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved writing apparatus that provides a writing tool and also provides a small compartment for mounting and holding a piece of food, preferably candy, for consumption.

DESCRIPTION OF THE PRIOR ART

U.S. Pat. No. 5,158,384, issued to Radmilovic et al., discloses a rear pen portion that has a notch defined longitudinally therein from a dividing wall to an upper end.

U.S. Pat. No. 5,826,997, issued to Coleman et al., discloses a pop-eye pen and candy holder that includes a main housing made of plastic or any suitable material.

U.S. Pat. No. 5,951,184, issued to Sanchez, discloses a new candy attachment for a writing instrument for allowing a user to removably mount candy to an end of a writing instrument.

U.S. Pat. No. 6,926,166, issued to Bitton et al., discloses a product combining individual novelty candy dispensers and health and beauty dispensers into a single device.

United States Application No. 2003/0155374, filed by Potier, discloses a breath spray pen with a hollow cylindrical shaped housing that tapers at one end and is open-ended at the opposite end.

SUMMARY OF THE INVENTION

The present invention concerns that of a new and improved writing apparatus that provides a writing tool and also provides a small compartment for mounting and holding a piece of food, preferably candy, for consumption. The writing apparatus is preferably a pen that includes an internal pen casing with a volume of ink. In addition, an item of food, preferably candy, is located in a rear-mounted compartment on the writing apparatus and can be exposed when an individual is hungry. A cap can be used to cover the item of food when an individual is not hungry or when the writing apparatus is being used for writing.

There has thus been outlined, rather broadly, the more important features of a writing apparatus that the detailed description thereof that follows may be better understood and in order that the present contribution to the art may be better appreciated. There are, of course, additional features of the writing apparatus that will be described hereinafter and which will form the subject matter of the claims appended hereto.

In this respect, before explaining at least one embodiment of the writing apparatus in detail, it is to be understood that the writing apparatus is not limited in its application to the details of construction and to the arrangements of the components set forth in the following description or illustrated in the drawings. The writing apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present writing apparatus. It is important, therefore, that the claims be regarded as including such equivalent constructions insofar as they do not depart from the spirit and scope of the present invention.

It is therefore an object of the present invention to provide a writing apparatus which has all of the advantages of the prior art and none of the disadvantages.

It is another object of the present invention to provide a writing apparatus which may be easily and efficiently manufactured and marketed.

It is another object of the present invention to provide a writing apparatus which is of durable and reliable construction.

It is yet another object of the present invention to provide a writing apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
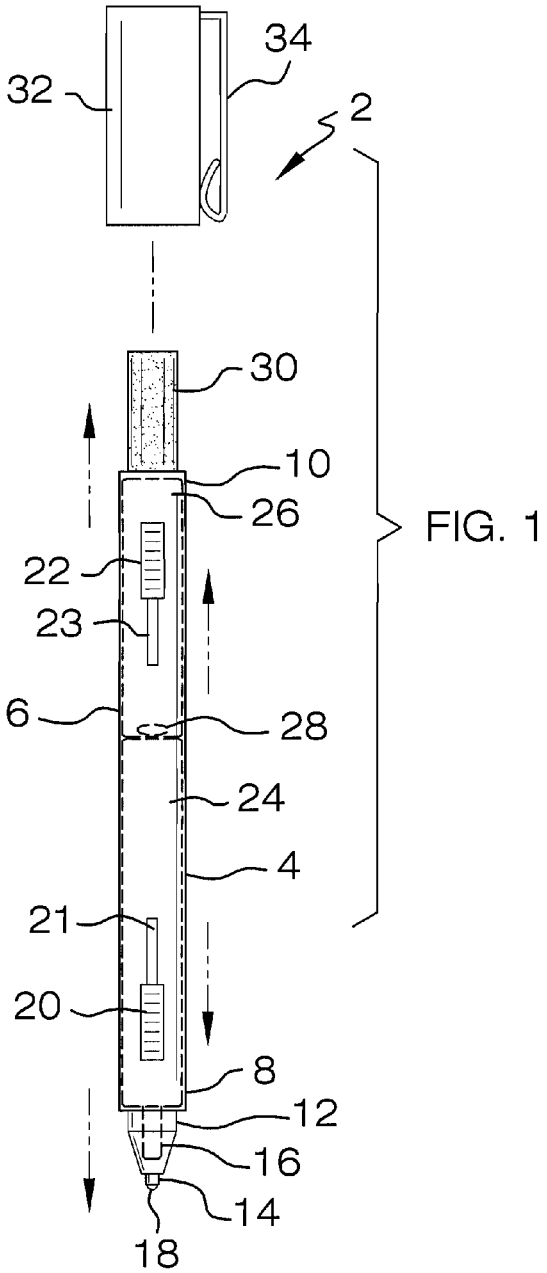
FIG. 1 shows a side view of the writing apparatus as it would appear with its cap removed.
Figure 2:
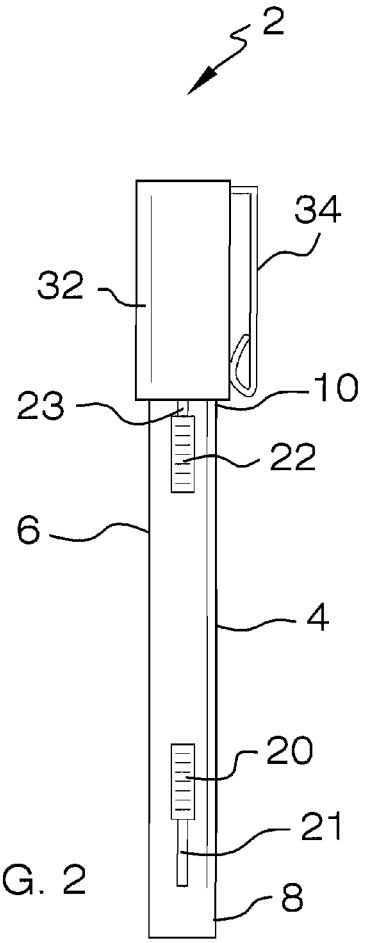
FIG. 2 shows a side view of the writing apparatus as it would appear with its cap attached.
Figure 3:
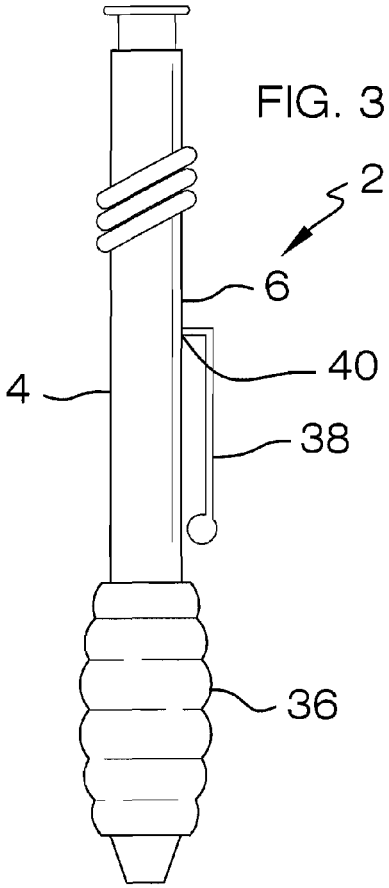
FIG. 3 shows a side view of an alternative embodiment of the writing apparatus as it would appear with its cap attached.
Figure 4:
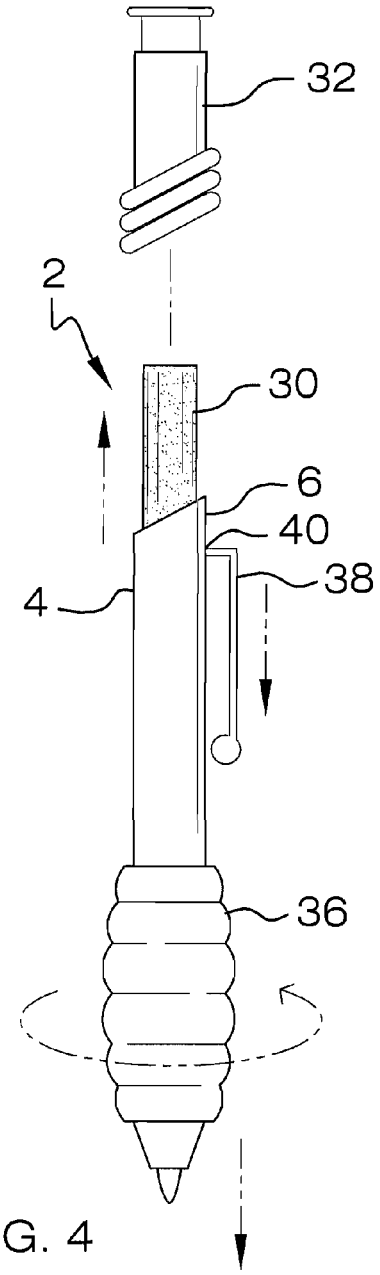
FIG. 4 shows a side view of an alternative embodiment of the writing apparatus as it would appear with its cap removed.

With reference now to the drawings, and in particular to FIGS. 1 through 6 thereof, a new writing apparatus embodying the principles and concepts of the present invention and generally designated by the reference numeral 2 will be described.

As best illustrated in FIGS. 1 through 5, the writing apparatus 2 comprises a pen 4, with the pen 4 comprising an outer casing 6. The outer casing 6 has two ends comprising a front end 8 and a rear end 10. The outer casing 6 is preferably cylindrical in shape and is hollow. The front end 8 and the rear end 10 of the outer casing 6 are open.

Within the outer casing 6 of the pen 4 are located two compartments comprising a front compartment 24 and a rear compartment 26. Each of the compartments 24 and 26 have two ends comprising a first end and a second end. The front compartment 24 is larger than the rear compartment 26 and is occupies about ⅗ to ⅔ of the length within the outer casing 6, while the rear compartment 26 occupies less space than the front compartment 24.

The front compartment 24 is located within a portion of the outer casing 6 that is closer to the front end 8 of the outer casing 6 than the rear end 10 of the outer casing 6. The first end of the front compartment 24 is located close to the front end 8 of the outer casing 6 but is not "flush" with the front end 8 of the outer casing 6. The first end of the rear compartment 26 is located close to the rear end 10 of the outer casing 6 but is not "flush" with the rear end 10 of the outer casing 6.

Within the front compartment 24 is located an internal pen casing 12 which has two ends, a first end and a second end. The internal pen casing 12 encloses a metal tubule 14 that houses a volume of ink 16. The metal tubule 14 has two ends, a first end and a second end, with the first end of the metal tubule comprising a rotating ball 18, through which, when pressed against a flat surface, the ink 16 within the metal tubule 14 can exit.

Within the rear compartment 26 is located a mount 28, to which an item of food 30 can be attached. Preferably, the item of food 30 is a piece of candy, with the candy having enough solidity to it to allow it to be mounted on mount 28 within the rear compartment 26.

Attached to the front compartment 24 is a front thumb tab 20. The front thumb tab 20 is attached to the front compartment 24 through a front track 21 that allows an individual to use the front thumb tab 20 to move the front compartment 24 back and forth. The front track 21 is approximately one to one and one-half inches long and provides a limitation to the amount of forward and backward movement the front compartment 24 actually has. The front track 21 is located near the front end of the outer casing 6.

When the front thumb tab 20 is pushed as far forward to the front end 8 of the outer casing 6 as it will go, the first end of the metal tubule 14 and the ball 18 are sticking out of the front end 8 of the outer casing 6, allowing an individual to use the writing utensil 2 for writing purposes. When the front thumb tab 20 is pushed as far away from the front end 8 of the outer casing 6 as it will go, the first end of the metal tubule 14 and the ball 18 are located within the outer casing 6 and the writing utensil 2 can not be used to write.

Attached to the rear compartment 26 is a rear thumb tab 22. The rear thumb tab 22 is attached to the rear compartment 26 through a rear track 23 that allows an individual to use the rear thumb tab 22 to move the rear compartment 26 back and forth. The rear track 23 is approximately one to one and one-half inches long and provides a limitation to the amount of forward and backward movement the rear compartment 26 actually has. The rear track 23 is located near the rear end of the outer casing 6.

When the rear thumb tab 22 is pushed as far forward to the rear end 6 of the outer casing 6 as it will go, the item of food 30 will be sticking out of the rear end 10 of the outer casing 6, allowing an individual to eat a portion or all of the item of food 30. When the rear thumb tab 22 is pushed as far away from the rear end 10 of the outer casing 6 as it will go, the item of food 30 is located within the rear compartment 26 and does not stick out of the rear end 10 of the outer casing 6 at all, thereby preventing it from being eaten.

When an individual wishes to cover the rear end 10 of the writing utensil, they can place a cap 32 over it. The cap 32 preferably has a clip 34 on it, which allows the writing utensil to be easily attached to a wide variety of items.

In an alternative embodiment, the writing utensil 2 can utilize a clip 38 instead of a rear thumb tab 22. The clip 38 would simply be attached to the rear compartment 26 in the same manner as the rear thumb tab 22 is, thereby allowing the clip 38 to serve both as an attachment device and also as a means for pushing out or pulling in the item of food.

Also in an alternative embodiment, the internal pen casing can be pulled out or pushed back into the front end of the outer casing 6 with the use of a twist-out mechanism 36. The twist-out mechanism 36, when rotated in a particular direction, pulls the internal pen casing 12 toward the front end of the outer casing 6, while when rotated the other way, pushes the internal pen casing 12 back in toward the front end of the outer casing 6.

Figure 5:
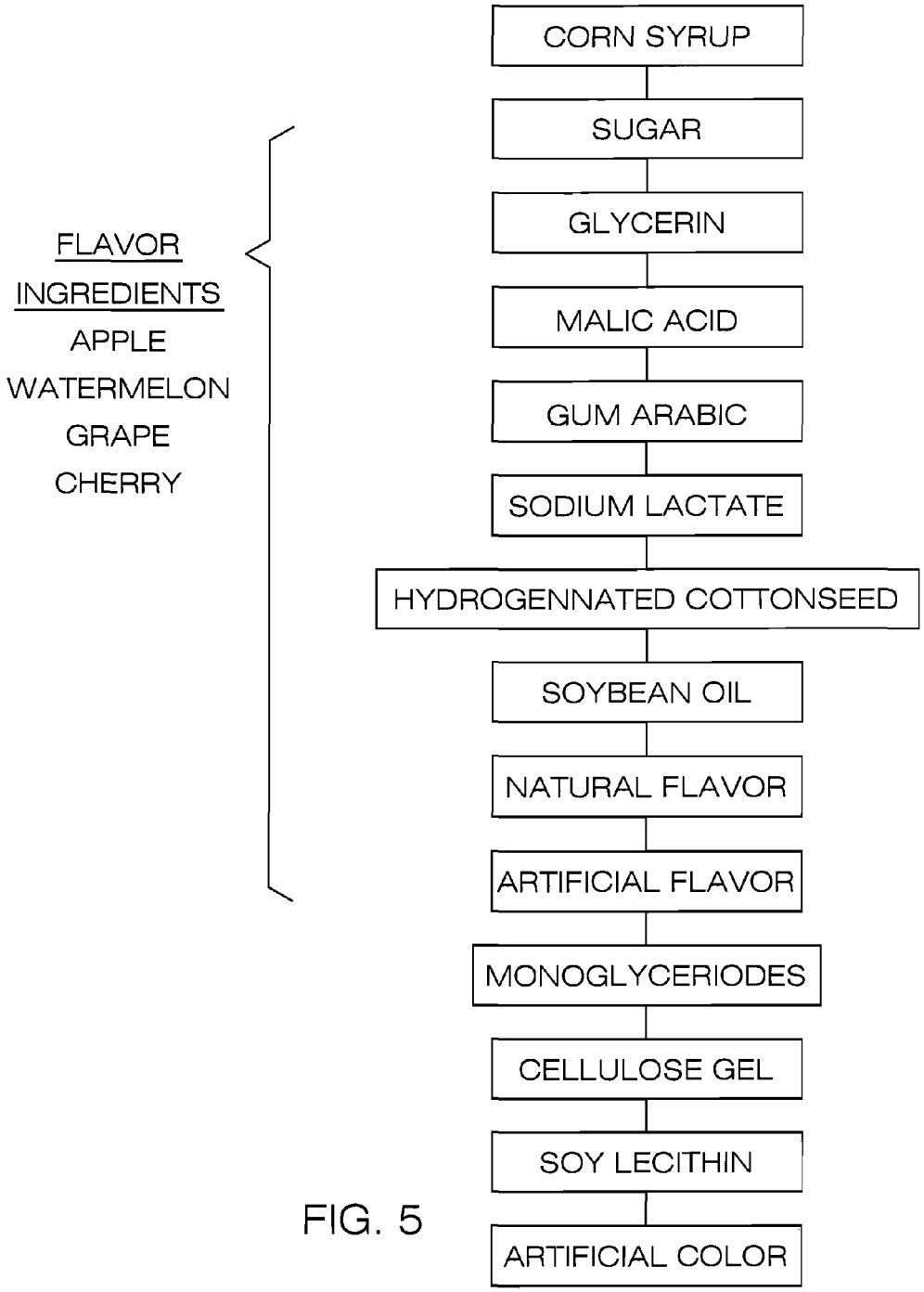
FIG. 5 shows a schematic diagram of possible ingredients that could be used to make the item of food placed within the writing apparatus.
Figure 6:
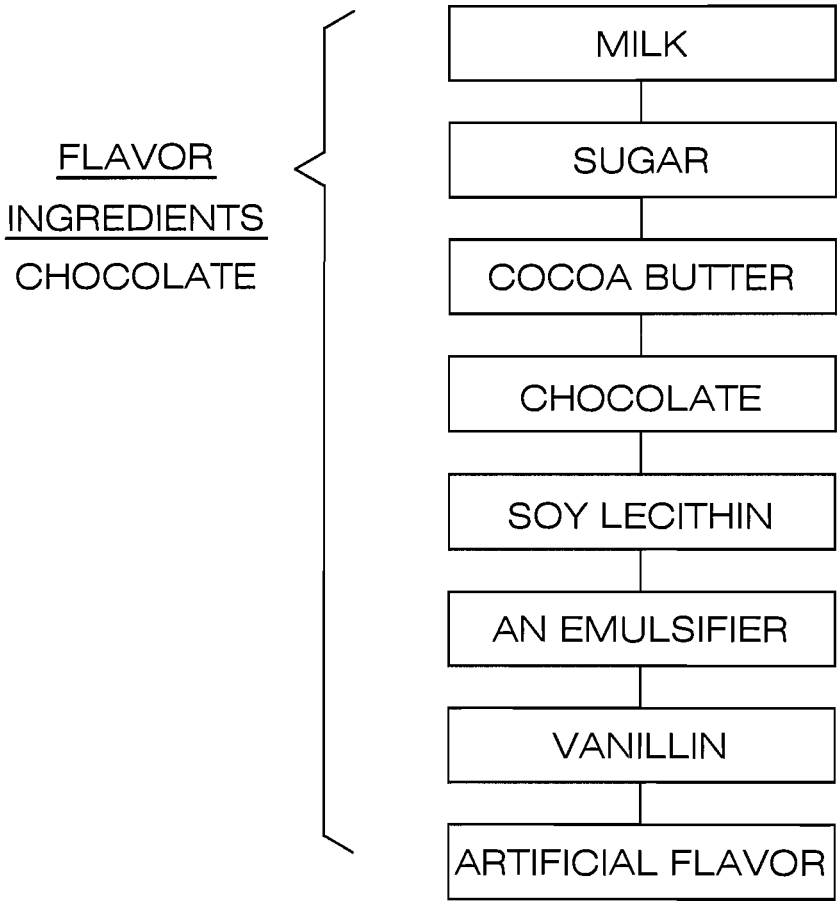
FIG. 6 shows a schematic diagram of possible ingredients that could be used to make the item of food placed within the writing apparatus.

The piece of food 30 itself can be made with various ingredients. If the item of food 30 is a piece of candy, FIGS. 5 and 6 represent some of the likely ingredients that would be used in manufacturing these items of candy.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim as my invention is:

1. A writing utensil comprising:

a pen having a front compartment and a rear compartment, each of the front compartment and the rear compartment having a first end and a second end, wherein the pen further comprises an outer casing having a front end and a rear end;

a writing device disposed within the front compartment of the outer casing an internal pen casing disposed within the front compartment having a first end and a second end;

a tubule disposed within the internal pen casing having a first end and a second end;

a volume of ink disposed within the tubule, wherein the ink is configured to be dispensed from the tubule through a rotating ball mounted on the first end of the tubule;

a front track disposed proximal the front end of the outer casing;

a piece of food disposed within the rear compartment of the outer casing, wherein the food can be partially ejected out through the rear end of the outer casing;

a rear track disposed proximal the rear end of the outer casing; and a mount disposed within the rear compartment, wherein the piece of food is secured on the mount.

2. A writing utensil according to claim 1 having a front thumb tab disposed on the front compartment through the front track, wherein the front thumb tab is configured to extend the writing device out of the front end of the outer casing.

3. A writing utensil according to claim 1 having a rear thumb tab disposed on the rear compartment through the rear track, wherein the rear thumb tab is configured to extend the piece of food out of the rear end of the outer casing.

4. A writing utensil according to claim 3 wherein the piece of food disposed within the rear compartment is a piece of candy.

5. A writing utensil according to claim 4 wherein the writing utensil further comprises a cap, wherein the cap is disposed over the rear end of the outer casing.

6. A writing utensil according to claim 5 wherein the cap further comprises a clip.

7. A writing utensil according to claim 1 having a clip disposed on the rear compartment through the rear track, wherein the clip is configured to extend the piece of food out of the rear end of the outer casing.

8. A writing utensil according to claim 1 having a twist-out mechanism disposed on the front end of the outer casing, wherein the twist-out mechanism is configured to partially eject the writing device out of the front end of the outer casing.

* * * * *